US009038697B2

(12) United States Patent
Ikeda

(10) Patent No.: US 9,038,697 B2
(45) Date of Patent: May 26, 2015

(54) ELECTRIC CURTAIN OPENING AND CLOSING DEVICE AND CURTAIN OPENING AND CLOSING METHOD USING THE SAME

(76) Inventor: Shigeo Ikeda, Tougane (JP)

( * ) Notice: Subject to any disclaimer, the term of this patent is extended or adjusted under 35 U.S.C. 154(b) by 13 days.

(21) Appl. No.: 13/819,169

(22) PCT Filed: Aug. 26, 2010

(86) PCT No.: PCT/JP2010/005267

§ 371 (c)(1),
(2), (4) Date: Feb. 26, 2013

(87) PCT Pub. No.: WO2012/025965

PCT Pub. Date: Mar. 1, 2012

(65) Prior Publication Data

US 2013/0160956 A1 Jun. 27, 2013

(51) Int. Cl.

| | |
|---|---|
| ***A47H 1/00*** | (2006.01) |
| ***A47H 5/02*** | (2006.01) |
| ***A47H 5/032*** | (2006.01) |
| ***A47H 1/04*** | (2006.01) |

(52) U.S. Cl.
CPC ..... *A47H 5/02* (2013.01); *A47H 5/0325* (2013.01); *A47H 1/04* (2013.01)

(58) Field of Classification Search
CPC ..... A47H 5/02; A47H 5/0325; A47H 1/04
USPC ..... 160/331, 340, 341, 123, 124
See application file for complete search history.

(56) References Cited

U.S. PATENT DOCUMENTS

| | | | | |
|---|---|---|---|---|
| 3,331,428 | A * | 7/1967 | Ford | 160/331 |
| 3,620,284 | A * | 11/1971 | Shayman et al. | 160/11 |
| 3,732,914 | A * | 5/1973 | Flageollet | 160/331 |
| 4,437,506 | A * | 3/1984 | Ogita | 160/331 |
| 4,965,498 | A * | 10/1990 | Yokota | 318/468 |
| 5,808,430 | A * | 9/1998 | Ho | 318/266 |
| 5,889,377 | A * | 3/1999 | Mao | 318/466 |
| 6,603,644 | B2 * | 8/2003 | Yeh | 361/31 |
| 6,755,230 | B2 * | 6/2004 | Ulatowski et al. | 160/84.02 |
| 8,498,747 | B2 * | 7/2013 | Feldstein | 700/275 |
| 2002/0105763 | A1 * | 8/2002 | Yeh | 361/31 |
| 2005/0172563 | A1 * | 8/2005 | Komoda | 49/358 |

(Continued)

FOREIGN PATENT DOCUMENTS

| | | |
|---|---|---|
| CN | 2436062 | 6/2001 |
| CN | 101711640 | 5/2010 |
| JP | 63-142178 | 9/1988 |
| JP | 11-342068 | 12/1999 |

(Continued)

*Primary Examiner* — Katherine Mitchell
*Assistant Examiner* — Scott Denion
(74) *Attorney, Agent, or Firm* — Jordan and Hamburg LLP

(57) ABSTRACT

An electric curtain opening and closing device includes a curtail rail and a movable body arranged in the curtail rail. The curtain rail has a hollow portion that is hollow extending in a longitudinal direction, and an opening opened in the longitudinal direction on its bottom face. Power supply patterns for supplying electricity are arranged inside left and right side faces that constitute the hollow portion in the longitudinal direction. The movable body has electrodes in contact with the respective power supply patterns, an electric motor receiving electricity through these electrodes to positively or negatively rotate, and a hanging portion for hanging a curtain. The movable body is driven to move by the electric motor. When the movable body is arranged in the hollow portion of the curtain rail, the hanging portion protrudes from the opening of the curtain rail.

8 Claims, 8 Drawing Sheets

(56) References Cited

U.S. PATENT DOCUMENTS

| | | | | |
|---|---|---|---|---|
| 2010/0122781 | A1* | 5/2010 | Charleux et al. | 160/331 |
| 2011/0168341 | A1* | 7/2011 | Bosgoed | 160/331 |
| 2012/0173024 | A1* | 7/2012 | Feldstein | 700/275 |
| 2013/0127603 | A1* | 5/2013 | Choo et al. | 340/12.5 |

FOREIGN PATENT DOCUMENTS

| | | |
|---|---|---|
| JP | 3080339 | 8/2000 |
| JP | 2001-037622 | 2/2001 |
| JP | 3084569 | 12/2001 |
| JP | 3252709 | 2/2002 |

* cited by examiner

ELECTRIC CURTAIN OPENING AND CLOSING DEVICE AND CURTAIN OPENING AND CLOSING METHOD USING THE SAME

BACKGROUND OF THE INVENTION

The present invention relates to an electric curtain opening and closing device for opening and closing a curtain, and a curtain opening and closing method using the same.

A curtain opening and closing device in which an electric movable body moves along a curtain rail has been known. A curtain is hung from the movable body, and can be opened and closed by moving the movable body.

For example, the curtain opening and closing device disclosed in Japanese Patent Laid-Open No. 2001-37622 moves the movable body by use of an electric motor built in the movable body.

The curtain opening and closing device disclosed in Japanese Utility Model Laid-Open No. 1-103385 moves the movable body by use of a linear motor. The linear motor includes a plurality of permanent magnets arranged on the curtain rail and an electric magnet arranged in the movable body.

SUMMARY OF THE INVENTION

However, the curtain opening and closing device described in Japanese Patent Laid-Open No. 2001-37622 supplies electricity from an AC adaptor installed on a wall or the like to the electric motor built in the movable body by means of an electric cord. Thus, when the movable body moves, the electric cord is dragged. Long-term use of the curtain opening and closing device may cause wear of the electric cord due to contact with the wall and the curtain rail, breakage of the electric cord, and deterioration of coating of the electric cord to generate an electric leakage.

The linear motor used for the curtain opening and closing device described in Japanese Patent Laid-Open No. 2001-37622 necessitates installing a lot of permanent magnets on the curtain rail over the moving range of the movable body. Further, it is necessary to alternately switch an N-pole and an S-pole of the electric magnet arranged in the movable body. This increases the weight of the curtain opening and closing device and in turn, costs.

An object of the present invention is to provide a lightweight and low-cost electric curtain opening and closing device that does not cause breakage and electric leakage of an electric cord, and a curtain opening and closing method using the same.

To attain the object, an electric curtain opening and closing device according to the present invention includes:

a curtain rail which has a hollow portion that is hollow extending in a longitudinal direction, one face constituting the hollow portion including an opening opened in the longitudinal direction, and in which a power supply pattern for supplying electricity is arranged on an inner side of any face constituting the hollow portion in the longitudinal direction; and a movable body which has an electrode in contact with the power supply pattern, an electric motor receiving electricity through the electrode to positively or negatively rotate, and a hanging portion for hanging a curtain, and which moves by being driven by the electric motor, wherein when the movable body is arranged in the hollow portion of the curtain rail, the hanging portion protrudes from the opening.

Preferably, in the electric curtain opening and closing device according to the present invention, the power supply pattern includes:

a first power supply pattern extending in the longitudinal direction, and having a first conducting portion and a second conducting portion each including a conductor that passes electricity and a first insulating portion sandwiched between the first conducting portion and the second conducting portion and including an insulator that does not pass electricity; and a second power supply pattern extending in the longitudinal direction, and having a third conducting portion and a fourth conducting portion each including a conductor that passes electricity and a second insulating portion sandwiched between the third conducting portion and the fourth conducting portion and including an insulator that does not pass electricity.

Preferably, the electric curtain opening and closing device according to the present invention is a curtain opening and closing device for a two-way draw curtain, wherein the device includes:

a first power source applying a first voltage between the first conducting portion of the first power supply pattern and the third conducting portion of the second power supply pattern; and a second power source applying a second voltage between the second conducting portion of the first power supply pattern and the fourth conducting portion of the second power supply pattern, and wherein the one movable body moves by electricity supplied from the first power source, and the another movable body moves by electricity supplied from the second power source.

Preferably, the electric curtain opening and closing device according to the present invention is a curtain opening and closing device for a one-way draw curtain, wherein the device includes a power source applying a same voltage between the first conducting portion of the first power supply pattern and the third conducting portion of the second power supply pattern, and between the second conducting portion of the first power supply pattern and the fourth conducting portion of the second power supply pattern, and wherein the one movable body moves by electricity supplied from the power source.

Preferably, the electric curtain opening and closing device according to the present invention includes a wireless signal transmission device that transmits a wireless signal for controlling movement of the movable body, wherein in response to the wireless signal transmitted from the wireless signal transmission device, the curtain rail controls electricity supplied to the power supply pattern to control the movement of the movable body.

An electric curtain opening and closing method according to the present invention is a curtain opening and closing method for opening and closing a two-way draw curtain including one curtain and the other curtain, the method including the steps of:

applying a first voltage between the first conducting portion of the first power supply pattern and the third conducting portion of the second power supply pattern in the above described electric curtain opening and closing device of the invention to move the one movable body and opening or closing one curtain hung from the hanging portion of the one movable body; and applying a second voltage between the second conducting portion of the first power supply pattern and the fourth conducting portion of the second power supply pattern in the above described electric curtain opening and closing device of the invention to move the another movable body and opening or closing the other curtain hung from the hanging portion of the another movable body.

An electric curtain opening and closing method according to the present invention is a curtain opening and closing method for opening and closing a one-way draw curtain including one curtain, the method including the step of:

applying a same voltage between the first conducting portion of the first power supply pattern and the third conducting portion of the second power supply pattern, and between the second conducting portion of the first power supply pattern and the fourth conducting portion of the second power supply pattern in the above described electric curtain opening and closing device of the invention to move the one movable body and opening or closing the curtain hung from the hanging portion of the movable body.

According to the present invention, it is possible to provide a light-weight and low-cost electric curtain opening and closing device that does not cause a breakage and an electric leakage of an electric cord.

DETAILED DESCRIPTION OF THE INVENTION

Electric curtain opening and closing devices in accordance with embodiments of the present invention will be described with reference to the figures.

Figure 1:
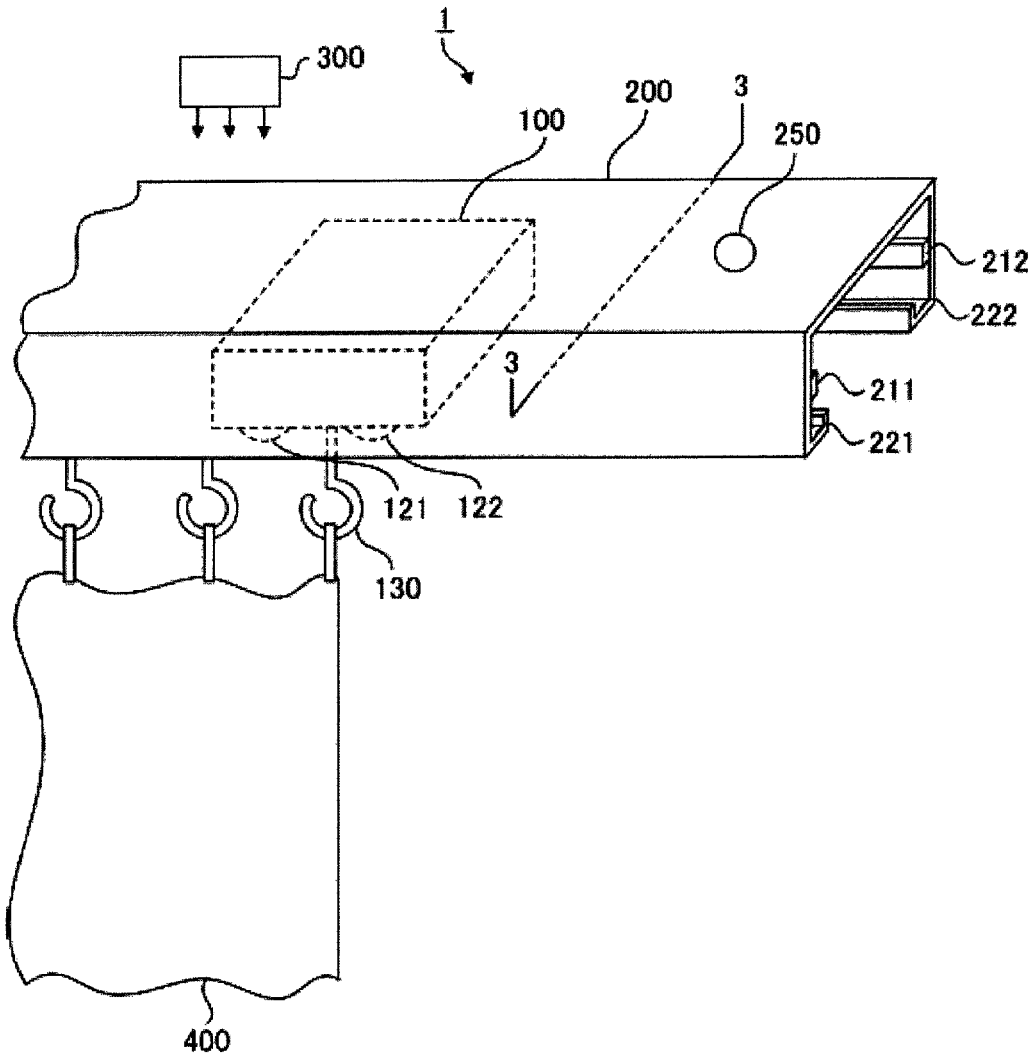
FIG. 1 is a view showing an example of a configuration of an electric curtain opening and closing device in accordance with a first embodiment of the present invention.

FIG. 1 shows an example of a configuration of an electric curtain opening and closing device 1 in accordance with the first embodiment of the present invention. The electric curtain opening and closing device 1 is a one-way draw curtain including one curtain.

The electric curtain opening and closing device 1 includes a movable body 100, a curtain rail 200, a control unit 300, and a power source not shown.

The movable body 100 has a hanging fitting 130 at a lower portion. A curtain 400 is hung from the hanging fitting 130, and the movable body 100 is moved along the curtain rail 200, thereby opening and closing the curtain 400.

The control unit 300 controls the entire electric curtain opening and closing device 1.

Figure 2A:
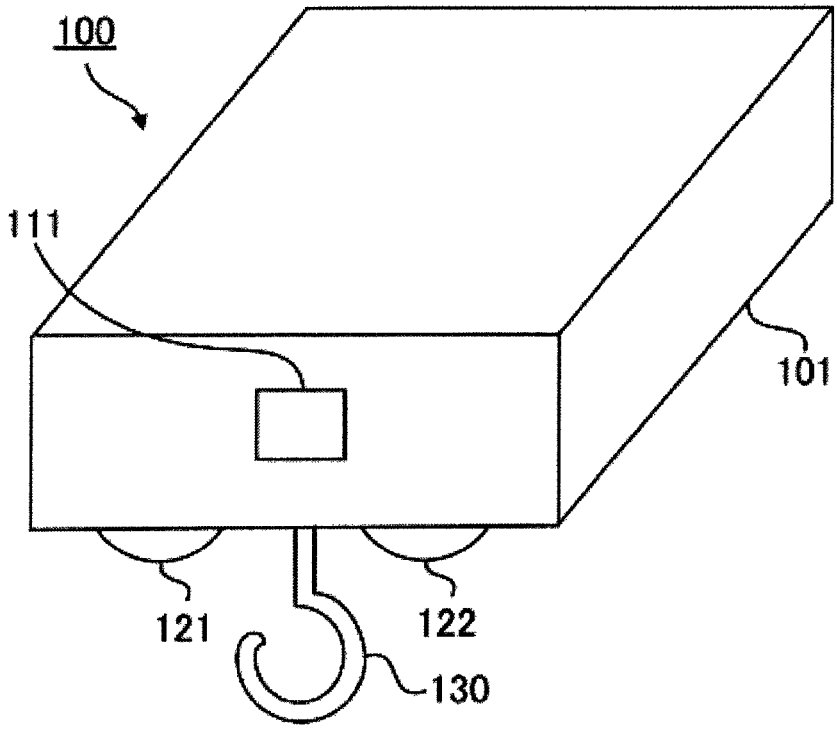
FIG. 2(A) is a perspective view showing an example of appearance of a movable body.
Figure 2B:
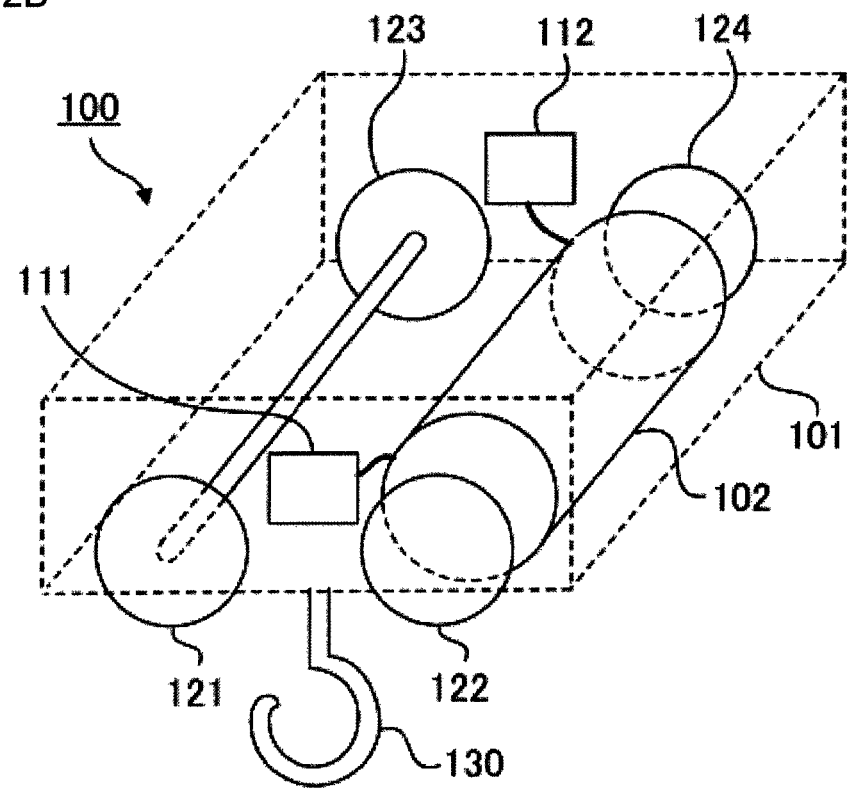
FIG. 2(B) is a perspective view showing an example of an internal configuration of the movable body.

As shown in FIG. 2, the movable body 100 includes, in addition to the hanging fitting 130, a housing 101, an electric motor 102, an electrode 111, an electrode 112, a wheel 121, a wheel 122, a wheel 123, and a wheel 124.

The electric motor 102 is built in the housing 101. The electrode 111 and the electrode 112 are arranged on a right side face and a left side face of the housing 101, respectively. The wheel 121, the wheel 122, the wheel 123, and the wheel 124 are arranged at four corners of a bottom face of the housing 101, and the hanging fitting 130 is arranged at the center of the bottom face.

Figure 3:
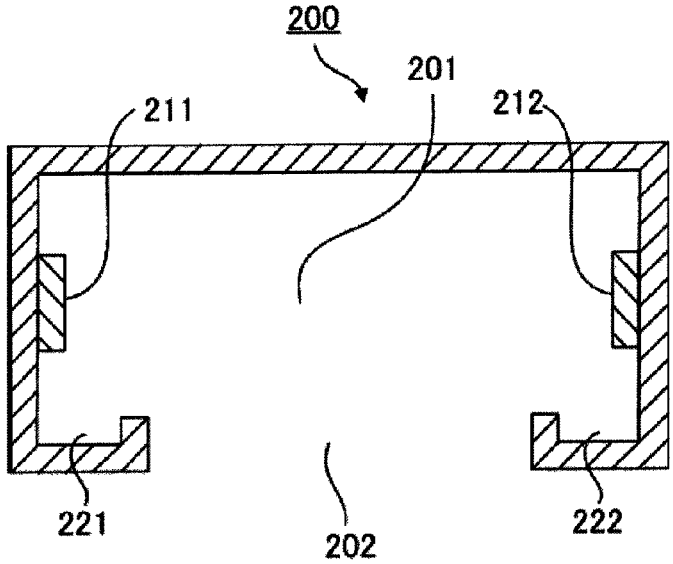
FIG. 3 is a sectional view showing a cross section taken along a line 3-3 in FIG. 1.

As shown in FIG. 3, the curtain rail 200 has a hollow portion 201, an opening 202, a power supply pattern 211, a power supply pattern 212, a wheel travelling portion 221, and a wheel travelling portion 222. As shown in FIG. 1, the curtain rail 200 has a detector 250 in the vicinity of a right end of an upper face. The curtain rail 200 further has a detector not shown in the vicinity of a left end of the upper face.

The hollow portion 201 that is hollow is located in the curtain rail 200. As shown in FIG. 1, the movable body 100 is arranged in the hollow portion 201 of the curtain rail 200. The hanging fitting 130 protrudes downward from the opening 202.

The power supply pattern 211 and the power supply pattern 212 each include a conductor that passes electricity. The power supply pattern 211 and the power supply pattern 212 extend along a left inner side face and a right inner side face of the curtain rail 200, respectively. A positive or negative voltage is applied to the power supply pattern 211 and the power supply pattern 212 from the power source not shown. When the positive voltage is applied to the power supply pattern 211, the negative voltage is applied to the power supply pattern 212. On the other hand, when the negative voltage is applied to the power supply pattern 211, the positive voltage is applied to the power supply pattern 212. The control unit 300 can control the power source to switch the positive and negative of the voltage applied to the power supply pattern 211 and the power supply pattern 212. The control unit 300 also can control the power source to change the magnitude of the voltage applied to the power supply pattern 211 and the power supply pattern 212.

The electrode 111 and the electrode 112 provided on the left side face and the right side face of the movable body 100, respectively, each have, for example, a brush, and the brushes contact the power supply pattern 211 and the power supply pattern 212 to supply power to the electric motor 102.

The electric motor 102 receives power from the power source through the pair of electrode 111 and electrode 112, and rotates. The electric motor 102 is, for example, a DC motor, and rotates in both of positive and negative directions. When the positive and negative of the voltage applied to the electrode 111 and the electrode 112 is switched, positive rotation and negative rotation of the electric motor 102 are switched. As the voltage applied to the electrode 111 and the electrode 112 increases, rotating speed of the electric motor 102 increases, and as the voltage decreases, the rotating speed of the electric motor 102 decreases.

When the electric motor 102 rotates, the wheel 122 and the wheel 124 rotate, and the movable body 100 moves along the curtain rail 200. When the movable body 100 moves, the wheel 121 and the wheel 122 move on the wheel travelling portion 221 of the curtain rail 200, and the wheel 123 and the wheel 124 move on the wheel travelling portion 222.

The control unit 300 operates the power source to control the positive and negative of the voltage applied to the power supply pattern 211 and the power supply pattern 212, thereby controlling the direction in which the movable body 100 moves. The control unit 300 operates the power source to control the magnitude of the voltage applied to the power supply pattern 211 and the power supply pattern 212, thereby controlling the moving speed of the movable body 100.

The detector 250 in the vicinity of the right end and the detector not shown in the vicinity of the left end each are, for example, a contact switch. When detecting that the movable body 100 contacts the detector 250 in the vicinity of the right end and the detector not shown in the vicinity of the left end, the control unit 300 turns off the power source to stop the movable body 100. Accordingly, when the movable body 100 moves to completely open or close the curtain 400, the movable body 100 automatically stops.

In the electric curtain opening and closing device 1 in accordance with the first embodiment, one curtain is hung from the hanging fitting 130 of the movable body 100.

When the curtain is opened/closed, the control unit 300 applies a voltage between the power supply pattern 211 and the power supply pattern 212 to move the movable body 100. Thereby, one curtain hung from the hanging fitting 130 of the movable body 100 is opened/closed.

When the movable body 100 is located between the power supply pattern 211 and the power supply pattern 212, the control unit 300 can stop or move the movable body 100 at any position. That is, the control unit 300 may be brought into the completely-opened state, a partially opened state, or the completely-closed state of one curtain.

Figure 4:
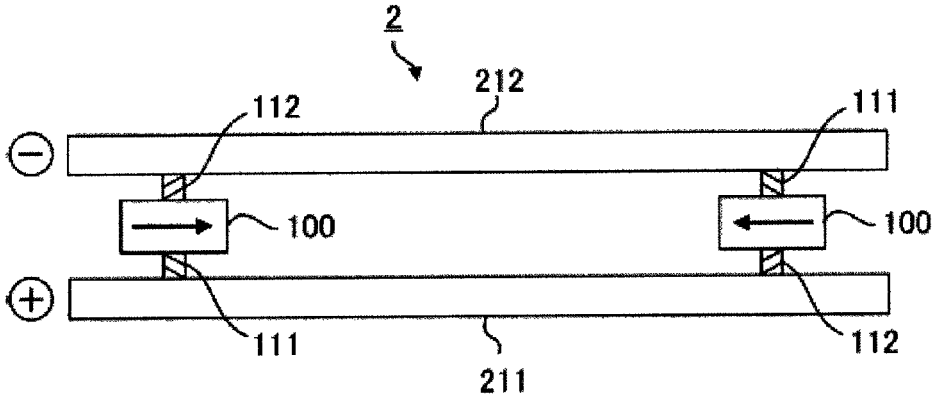
FIG. 4 is a schematic view showing an example of a configuration of an electric curtain opening and closing device in accordance with a second embodiment of the present invention.
Figure 5:
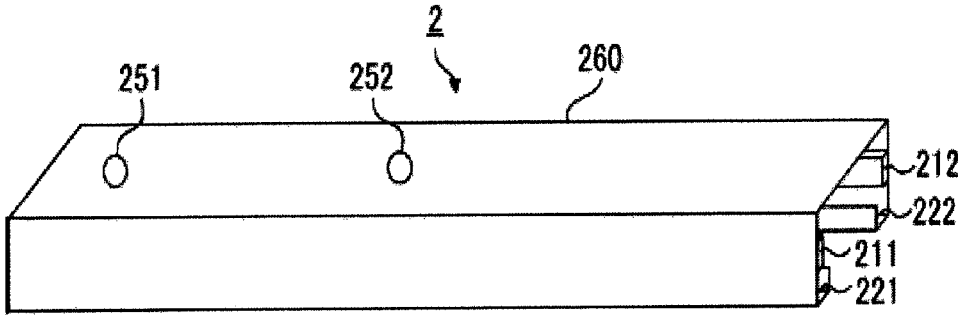
FIG. 5 is a perspective view showing an example of appearance of the electric curtain opening and closing device in accordance with the second embodiment of the present invention.

FIG. 4 and FIG. 5 show an example of a configuration of an electric curtain opening and closing device 2 in accordance with the second embodiment of the present invention. The electric curtain opening and closing device 2 is for a two-way draw curtain that is opened to the left side or the right side.

The electric curtain opening and closing device 2 includes two movable bodies 100, a curtain rail 260, a control unit 300, and a power source not shown.

The movable body 100 included in the electric curtain opening and closing device 2 has the same configuration as the movable body 100 included in the electric curtain opening and closing device 1 in accordance with the first embodiment.

The curtain rail 260 has the hollow portion 201, the opening 202, the power supply pattern 211, the power supply pattern 212, the wheel travelling portion 221, the wheel travelling portion 222, a detector 251, and a detector 252.

The curtain rail 260 includes no detector 250 arranged in the vicinity of the right end of the upper face of the curtain rail 200 included in the electric curtain opening and closing device 1, and includes the detector 252 arranged a little to the left with respect to the center of the upper face of the curtain rail 260. Except for this, the curtain rail 260 has the same configuration as the curtain rail 200. The detector 251 arranged in the vicinity of the left end of the upper face also exists in the electric curtain opening and closing device 1 (the detector 251 is not shown in FIG. 1).

The same constituents in FIG. 4 and FIG. 5 as those in FIG. 1 are given the same reference numerals, and description thereof is omitted.

For ease of understanding, FIG. 4 shows only the power supply pattern 211, the power supply pattern 212, and a rectangle representing the movable body 100. An arrow added to the rectangle representing the movable body 100 shows an orientation of the movable body 100. When the positive electrode is applied to the electrode 111 and the negative voltage is applied to the electrode 112, the movable body 100 moves in the direction of the arrow. On the other hand, when the negative voltage is applied to the electrode 111 and the positive voltage is applied to the electrode 112, the movable body 100 moves in a direction opposite to the arrow.

As shown in FIG. 4, when the positive (+) voltage and the negative (−) voltage are applied to the power supply pattern 211 and the power supply pattern 212, respectively, the left movable body 100 moves to the right, and the right movable body 100 moves to the left. That is, two movable bodies 100 move to close the curtain.

When detecting that the left movable body 100 contacts the detector 251 in the vicinity of the left end or the detector 252 located a little to the left with respect to the center, the control unit 300 turns off the power source to stop the left movable body 100 and the right movable body 100 at the same time.

In the electric curtain opening and closing device 2 in accordance with the second embodiment, the left curtain is hung from the hanging fitting 130 of the left movable body 100, and the right curtain is hung from the hanging fitting 130 of the right movable body 100.

The control unit 300 applies the voltage between the power supply pattern 211 and the power supply pattern 212 to move the left movable body 100 and the right movable body 100 at the same time. Thereby, the left curtain and the right curtain are opened or closed at the same time.

Figure 6A:
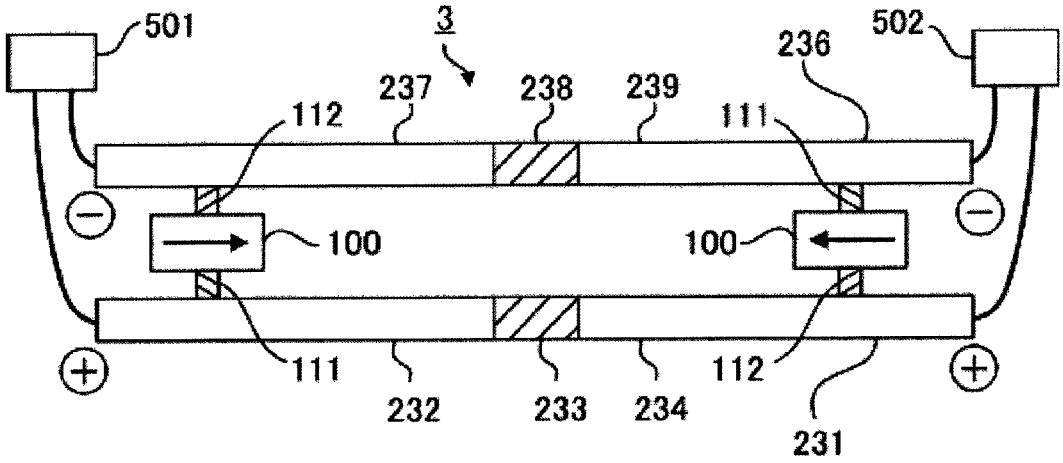
FIG. 6(A) is a schematic view showing an example of a configuration of an electric curtain opening and closing device in accordance with a third embodiment of the present invention.
Figure 6B:
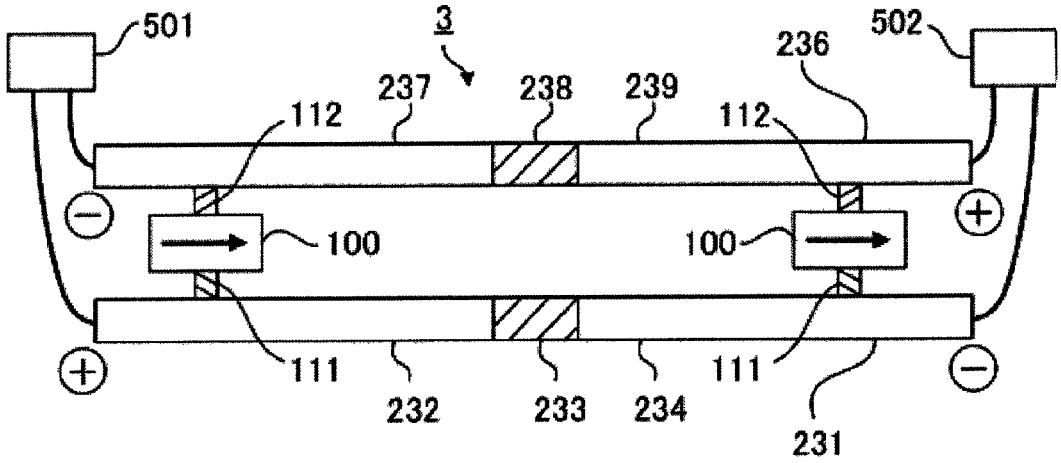
FIG. 6(B) is a schematic view showing another example of the configuration of the electric curtain opening and closing device in accordance with the third embodiment of the present invention.
Figure 7:
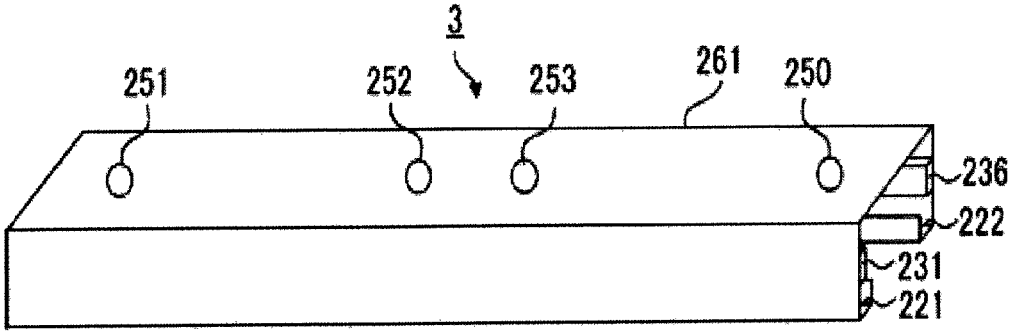
FIG. 7 is a perspective view showing an example of appearance of the electric curtain opening and closing device in accordance with the third embodiment of the present invention.

FIG. 6 and FIG. 7 show an example of a configuration of an electric curtain opening and closing device 3 in accordance with the third embodiment of the present invention. The electric curtain opening and closing device 3 is for the two-way draw curtain.

In the two-way draw curtain, the left and right curtains are different from each other in weight, or either the left or right curtain may get stuck on an obstacle. Depending on the configuration of the electric motor 102, even when the same voltage is applied to the electric motor 102, the moving speed of the movable body 100 may vary according to whether the rotation is positive rotation or negative rotation. In such case, in the electric curtain opening and closing device 2 in accordance with the second embodiment, a difference in the moving speed between the left movable body 100 and the right movable body 100 is generated. For this reason, in the electric curtain opening and closing device 2, a gap between the left and right curtains and collision between the two movable bodies 100 may occur.

However, the electric curtain opening and closing device 3 in accordance with the third embodiment can individually control the moving direction and the moving speed of the left movable body 100 and the right movable body 100. The electric curtain opening and closing device 3 also can move one movable body 100 while stopping the other movable body 100.

The electric curtain opening and closing device 3 includes the two movable bodies 100, a curtain rail 261, a control unit 300, a power source 501, and a power source 502.

The movable body 100 included in the electric curtain opening and closing device 3 has the same configuration as the movable body 100 included in the electric curtain opening and closing device 1 in accordance with the first embodiment.

The curtain rail 261 has a hollow portion 201, an opening 202, a power supply pattern 231, a power supply pattern 236, a wheel travelling portion 221, a wheel travelling portion 222, a detector 250, a detector 251, a detector 252, and a detector 253.

The same constituents in FIG. 6 and FIG. 7 as those in FIG. 1, FIG. 4, and FIG. 5 are given the same reference numerals, and description thereof is omitted.

As in FIG. 4, for ease of understanding, FIG. 6(A) and FIG. 6(B) show only the power supply pattern 231, the power supply pattern 236, patterns representing the movable bodies 100, a power source 501, and a power source 502. Arrows added to the patterns representing the movable bodies 100 have the same meaning as in FIG. 4. Note that, in FIG. 6(A), the left movable body 100 and the right movable body 100 are oriented in opposite directions, and in FIG. 6(B), the left movable body 100 and the right movable body 100 are oriented in the same direction.

The power supply pattern 231 is configured such that a first conducting portion 232 and a second conducting portion 234 are located on the left side and the right side, respectively, and a first insulating portion 233 is sandwiched between the first conducting portion 232 and the second conducting portion 234. Similarly, the power supply pattern 236 is configured such that a third conducting portion 237 and a fourth conducting portion 239 are located on the left side and the right side, respectively, and a second insulating portion 238 is sandwiched between the third conducting portion 237 and the fourth conducting portion 239. The first conducting portion 232, the second conducting portion 234, the third conducting portion 237, and the fourth conducting portion 239 each include a conductor that passes electricity. The first insulating portion 233 and the second insulating portion 238 each include an insulator that does not pass electricity.

The power source 501 applies a voltage between the left first conducting portion 232 of the power supply pattern 231 and the left third conducting portion 237 of the power supply pattern 236. In addition, the power source 502 applies a voltage between the right second conducting portion 234 of the power supply pattern 231 and the right fourth conducting portion 239 of the power supply pattern 236.

The control unit 300 operates the power source 501 to control the positive and negative and the magnitude of the voltage applied to the left first conducting portion 232 of the power supply pattern 231 and the left third conducting portion 237 of the power supply pattern 236. Thereby, the control unit 300 can control the moving direction and the moving speed of the left movable body 100.

Similarly, the control unit 300 operates the power source 502 to control the positive and negative and the magnitude of the voltage applied to the right second conducting portion 234 of the power supply pattern 231 and the right fourth conducting portion 239 of the power supply pattern 236. Thereby, the control unit 300 can control the moving direction and the moving speed of the right movable body 100.

The detector 253 is arranged a little to the right with respect to the center of the upper face of the curtain rail 261. When detecting that the left movable body 100 contacts the detector 251 in the vicinity of the left end or the detector 252 located a little to the left with respect to the center, the control unit 300 turns off the power source 501 to stop the left movable body 100. Similarly, when detecting that the right movable body 100 contacts the detector 253 located a little to the left with respect to the center or the detector 250 in the vicinity of the right end, the control unit 300 turns off the power source 502 to stop the right movable body 100.

The electric curtain opening and closing device 3 in accordance with the third embodiment controls the positive and negative of the voltage applied to the first conducting portion 232 and the third conducting portion 237, and the second conducting portion 234 and the fourth conducting portion 239, thereby controlling the direction in which the left movable body 100 and the right movable body 100 move. For example, in FIG. 6(A), the positive (+) voltage and the negative (−) voltage are applied to the first conducting portion 232 and the third conducting portion 237, respectively, and the positive (+) voltage and the negative (−) voltage are applied to the second conducting portion 234 and the fourth conducting portion 239, respectively. At this time, the left movable body 100 and the right movable body 100 move so as to close the left and right curtains. On the other hand, in FIG. 6(B), the positive (+) voltage and the negative (−) voltage are applied to the first conducting portion 232 and the third conducting portion 237, respectively, and the negative (−) voltage and the positive (+) voltage are applied to the second conducting portion 234 and the fourth conducting portion 239, respectively. Also in this case, as in FIG. 6(A), the left movable body 100 and the right movable body 100 move so as to close the left and right curtains.

In the electric curtain opening and closing device 3 in accordance with the third embodiment, the left curtain is hung from the hanging fitting 130 of the left movable body 100, and the right curtain is hung from the hanging fitting 130 of the right movable body 100.

In the case of opening or closing the left curtain, the control unit 300 allows the power source 501 to apply a voltage between the first conducting portion 232 of the power supply pattern 231 and the third conducting portion 237 of the power supply pattern 236, thereby moving the left movable body 100. Thereby, the left curtain hung from the hanging fitting 130 of the left movable body 100 is opened and closed.

In the case of opening or closing the right curtain, the control unit 300 allows the power source 502 to apply a voltage between the second conducting portion 234 of the power supply pattern 231 and the fourth conducting portion 239 of the power supply pattern 236, thereby moving the right movable body 100. Thereby, the right curtain hung from the hanging fitting 130 of the right movable body 100 is opened and closed.

The control unit 300 can individually move the left movable body 100, and when the left movable body 100 is located between the first conducting portion 232 and the third conducting portion 237, can stop or move the left movable body 100 at any position. That is, the control unit 300 can bring the left curtain into the completely-opened state, a partially opened state, or the completely-closed state, irrespective of the right curtain.

Similarly, the control unit 300 can also individually move the right movable body 100, and when the right movable body 100 is located between the second conducting portion 234 and the fourth conducting portion 239, can stop or move the right movable body 100 at any position. That is, the control unit 300 can bring the right curtain into the completely-opened state, a partially opened state, or the completely-closed state, irrespective of the left curtain.

Figure 8:
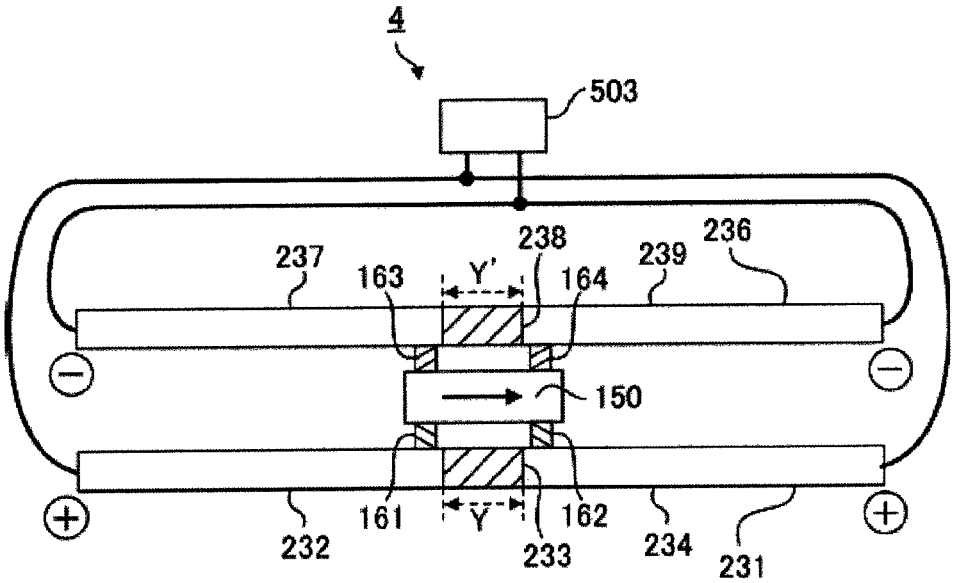
FIG. 8 is a schematic view showing an example of a configuration of an electric curtain opening and closing device in accordance with a fourth embodiment of the present invention.

FIG. 8 shows an example of a configuration of an electric curtain opening and closing device in accordance with the fourth embodiment of the present invention 4. The electric curtain opening and closing device 4 is for the one-way draw curtain.

The electric curtain opening and closing device 4 includes a movable body 150, a curtain rail 261, a control unit 300, and a power source 503.

The electric curtain opening and closing device 4 uses the curtain rail 261 included in the electric curtain opening and closing device 3 in accordance with the third embodiment to constitute the electric curtain opening and closing device for the one-way draw curtain.

The movable body 150 has a housing 101, an electric motor 102, an electrode 161, an electrode 162, an electrode 163, an electrode 164, a wheel 121, a wheel 122, a wheel 123, a wheel 124, and a hanging fitting 130. The movable body 150 has the same configuration as the movable body 100 except for including the four electrodes (the electrode 161, the electrode 162, the electrode 163, and the electrode 164) instead of two electrodes.

Figure 9:
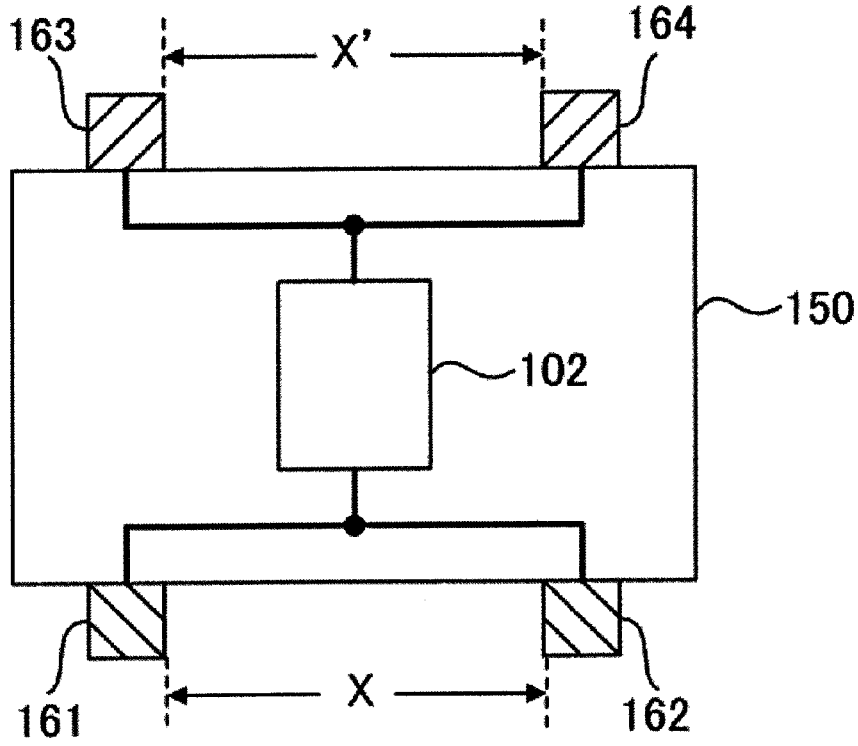
FIG. 9 is a schematic view showing an example of a configuration of a movable body included in the electric curtain opening and closing device in accordance with the fourth embodiment of the present invention.

As shown in FIG. 9, in the movable body 150, the electrode 161 and the electrode 162 are connected to each other, and have the same potential. The electrode 163 and the electrode 164 are also connected to each other, and have the same potential.

Figure 10:
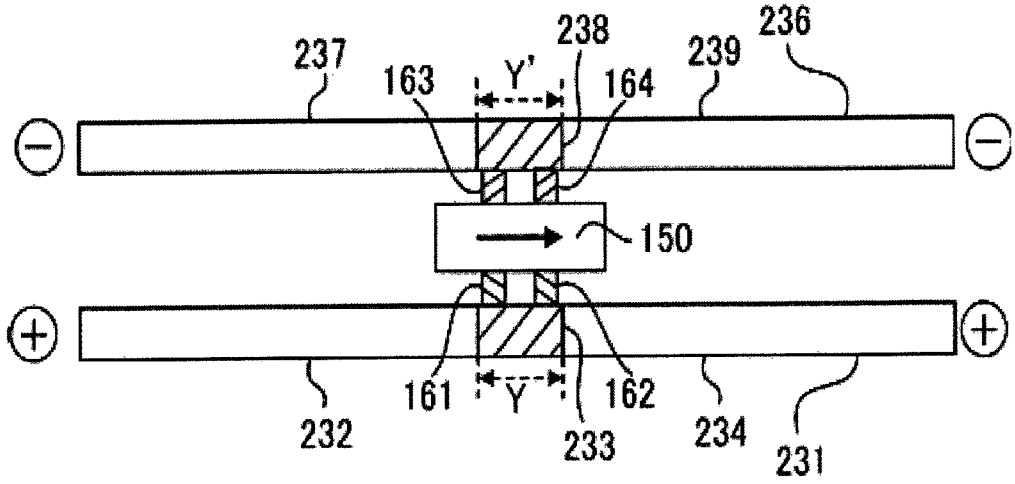
FIG. 10 is a schematic view showing an example of a configuration of an electric curtain opening and closing device in a comparative example of the electric curtain opening and closing device in accordance with the fourth embodiment.

For example, as shown in FIG. 10, it is assumed that a distance X between the electrode 161 and the electrode 162 is smaller than a width Y in the longitudinal direction of the first insulating portion 233, or a distance X' between the electrode 163 and the electrode 164 is smaller than a width Y' in the longitudinal direction of the second insulating portion 238. In this configuration, when the movable body 150 stops at a position where it is sandwiched between the insulating portion 233 and the insulating portion 238 as shown in FIG. 10, the control unit 300 cannot move the movable body 150 again.

For this reason, in the movable body 150, the distance X between the electrode 161 and the electrode 162 needs to be larger than the width Y in the longitudinal direction of the first insulating portion 233, and the distance X' between the electrode 163 and the electrode 164 needs to be larger than the width Y' in the longitudinal direction of the second insulating portion 238.

In the electric curtain opening and closing device 4 in accordance with the fourth embodiment, one curtain is hung from the hanging fitting 130 of the movable body 100.

In the case of opening and closing the curtain, the control unit 300 allows the power source 503 to apply the same voltage between the first conducting portion 232 of the power supply pattern 231 and the third conducting portion 237 of the power supply pattern 236, and between the second conducting portion 234 of the power supply pattern 231 and the fourth conducting portion 239 of the power supply pattern 236 to move the movable body 100. Thereby, one curtain hung from the hanging fitting 130 of the movable body 100 is opened and closed.

When the movable body 100 is located between the power supply pattern 231 and the power supply pattern 236, the control unit 300 can stop or move the movable body 100 at any position. That is, the control unit 300 can bring the one curtain into the completely-opened state, a partially opened state, or the completely-closed state.

Note that, the detector 252 and the detector 253 are provided for the electric curtain opening and closing device 3 for the two-way draw curtain. Thus, in the electric curtain opening and closing device 4, the control unit 300 ignores signals from the detector 252 and the detector 253.

Figure 11:
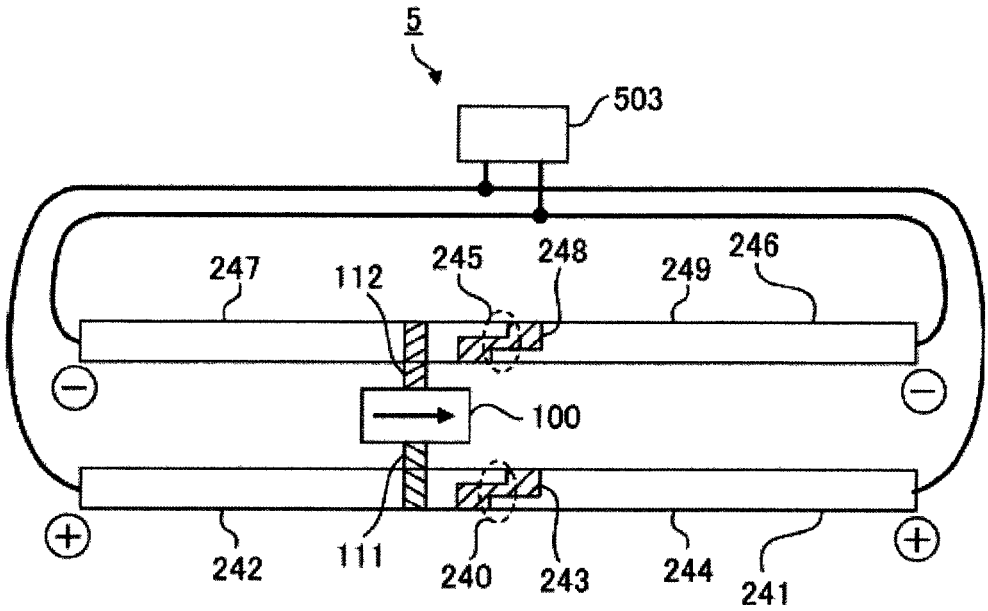
FIG. 11 is a schematic view showing a modification example of the electric curtain opening and closing device in accordance with the fourth embodiment of the present invention.
Figure 12:
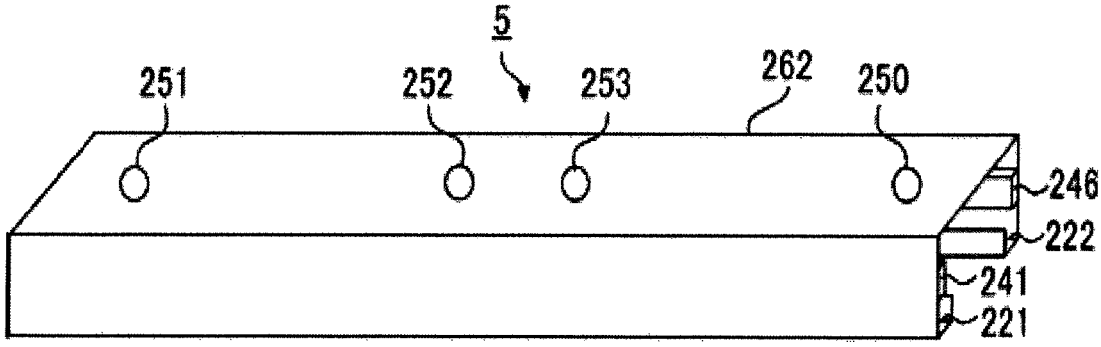
FIG. 12 is a perspective view showing an example of appearance of the modification example of the electric curtain opening and closing device in accordance with the fourth embodiment of the present invention.

FIG. 11 and FIG. 12 show an example of a configuration of an electric curtain opening and closing device 5 as a modification of the electric curtain opening and closing device 4 in accordance with the fourth embodiment of the present invention.

The electric curtain opening and closing device 5 includes a movable body 100, a curtain rail 262, a control unit 300, and a power source 503.

The curtain rail 262 has a power supply pattern 241 and a power supply pattern 246 in place of the power supply pattern 231 and the power supply pattern 236 in the curtain rail 261 of the electric curtain opening and closing device 4.

Like the power supply pattern 231, the power supply pattern 241 is configured such that a fifth conducting portion 242 and a sixth conducting portion 244 are located on the left side and the right side, respectively, and a third insulating portion 243 is sandwiched between the fifth conducting portion 242 and the sixth conducting portion 244. However, unlike the power supply pattern 231, the power supply pattern 241 has an overlapping portion 240 where the fifth conducting portion 242 and the sixth conducting portion 244 overlap each other in the third insulating portion 243.

Like the power supply pattern 236, the power supply pattern 246 is configured such that a seventh conducting portion 247 and an eighth conducting portion 249 are located on the left side and the right side, respectively, and a fourth insulating portion 248 is sandwiched between the seventh conducting portion 247 and the eighth conducting portion 249. However, unlike the power supply pattern 236, the power supply pattern 246 has an overlapping portion 245 where the seventh conducting portion 247 and the eighth conducting portion 249 overlap each other in the fourth insulating portion 248.

The fifth conducting portion 242, the sixth conducting portion 244, the seventh conducting portion 247, and the eighth conducting portion 249 each include a conductor that passes electricity. The third insulating portion 243 and the fourth insulating portion 248 each include an insulator that does not pass electricity.

Due to the presence of the overlapping portion 240 and the overlapping portion 245, even when the movable body 100 stops at a position where it is sandwiched between the third insulating portion 243 and the fourth insulating portion 248, the control unit 300 can move the movable body 100 again.

Figure 13:
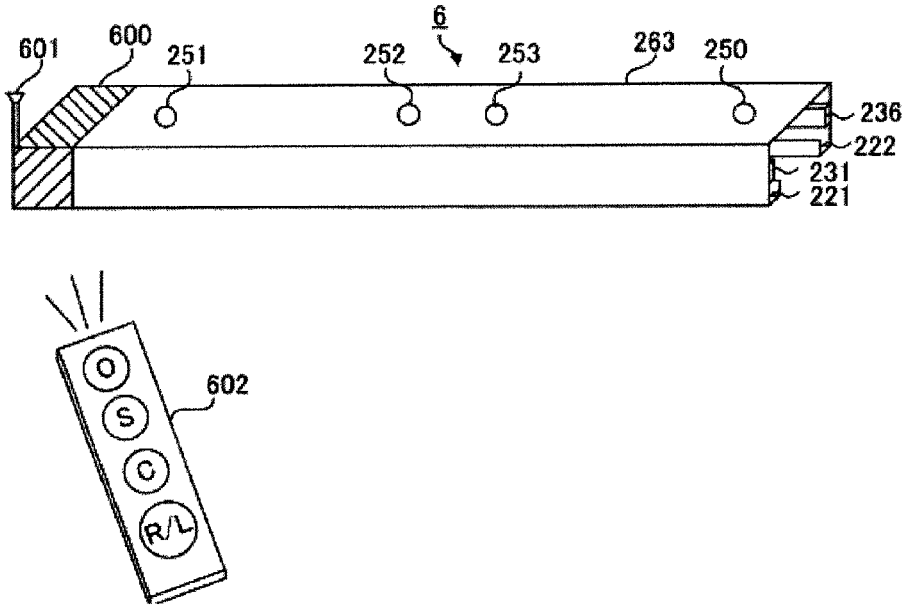
FIG. 13 is a perspective view showing an example of appearance of an electric curtain opening and closing device in accordance with a fifth embodiment of the present invention.

FIG. 13 shows an example of appearance of an electric curtain opening and closing device 6 in accordance with the fifth embodiment of the present invention. The electric curtain opening and closing device 6 is for the two-way draw curtain.

The electric curtain opening and closing device 6 includes two movable bodies 100, a curtain rail 263, a power source 501, a power source 502, and a remote controller (wireless signal transmission device) 602.

The movable body 100 included in the electric curtain opening and closing device 6 has the same configuration as the movable body 100 included in the electric curtain opening and closing device 3 in accordance with the third embodiment.

The curtain rail 263 has a hollow portion 201, an opening 202, a power supply pattern 231, a power supply pattern 236, a wheel travelling portion 221, a wheel travelling portion 222, a detector 250, a detector 251, a detector 252, a detector 253, a control unit 600, and an antenna 601.

The curtain rail 263 has the control unit 600 arranged in a housing of the curtain rail 263, and is different from the curtain rail 261 included in the electric curtain opening and closing device 3 in accordance with the third embodiment in that the antenna 601 for receiving a wireless signal is connected to the control unit 600. The control unit 600 has a reception circuit for the wireless signal therein.

The same constituents in FIG. 13 as those in FIG. 6 and FIG. 7 are given the same reference numerals and description thereof is omitted.

The remote controller 602 includes a button R/L (right/left) for selecting the movable body 100 arranged on the left side or the movable body 100 arranged on the right side, a button O (open), a button S (stop), and a button C (close) that controls the selected movable body 100. When the user presses any of these buttons, the remote controller 602 transmits a wireless signal, indicating that the button is pressed, to the antenna 601.

In response to the signal received by the antenna 601, the control unit 600 controls electricity supplied to the power supply pattern 231 and the power supply pattern 236 to move the two movable bodies 100.

Figure 14:
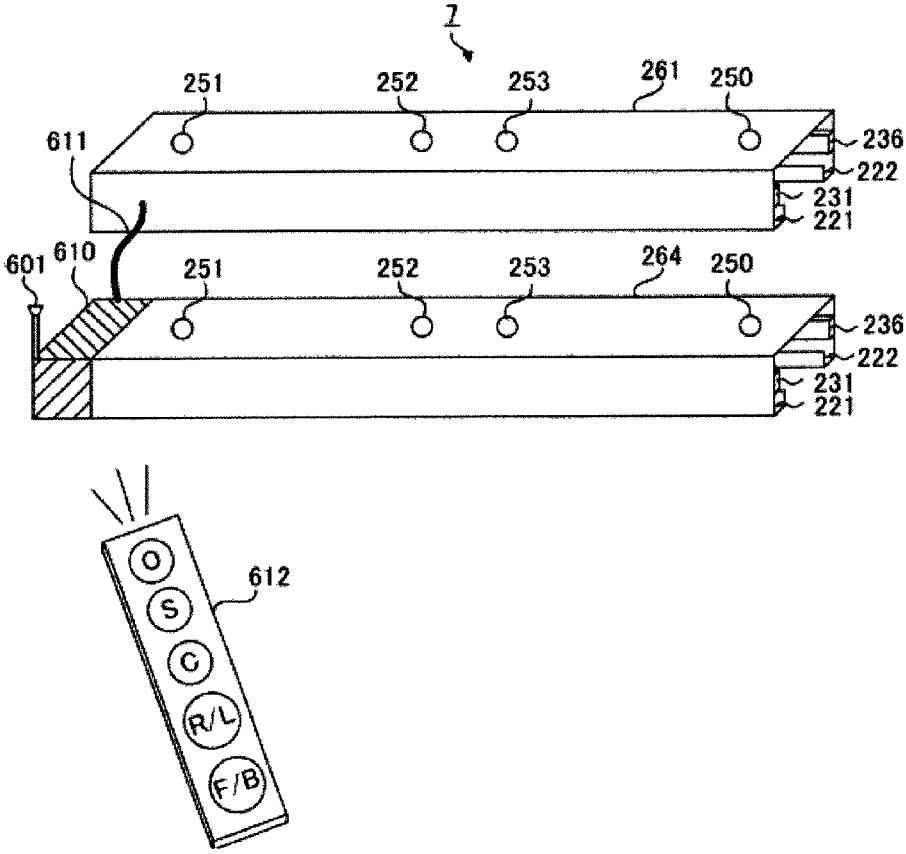
FIG. 14 is a perspective view showing an example of appearance of an electric curtain opening and closing device in accordance with a sixth embodiment of the present invention.

FIG. 14 shows an example of appearance of an electric curtain opening and closing device 7 in accordance with the sixth embodiment of the present invention. The electric curtain opening and closing device 7 is for a double curtain consisting of a thin curtain and a thick curtain, as well as the two-way draw curtain.

The electric curtain opening and closing device 7 includes four movable bodies 100, a curtain rail 261, a curtain rail 264, four power sources, and a remote controller (wireless signal transmission device) 612.

The movable body 100 included in the electric curtain opening and closing device 7 has the same configuration as the movable body 100 included in the electric curtain opening and closing device 3 in accordance with the third embodiment.

The curtain rail 261 has the same configuration as the curtain rail 261 included in the electric curtain opening and closing device 3 in accordance with the third embodiment.

The curtain rail 264 has a hollow portion 201, an opening 202, a power supply pattern 231, a power supply pattern 236, a wheel travelling portion 221, a wheel travelling portion 222, a detector 250, a detector 251, a detector 252, a detector 253, a control unit 610, and an antenna 601.

The curtain rail 264 includes a control signal line 611 for controlling the two movable bodies 100 arranged in the curtain rail 261. The curtain rail 264 is different from the curtain rail 263 included in the electric curtain opening and closing device 6 in accordance with the fifth embodiment in that the control unit 610 controls the movement of the two movable bodies 100 arranged in the curtain rail 264 and the movement of the two movable bodies 100 arranged in the curtain rail 261.

The control unit 610 is the same as the control unit 600 in that it has the reception circuit for the wireless signal.

The same constituents in FIG. 14 as those in FIG. 6, FIG. 7, and FIG. 13 are given the same reference numerals, and description thereof is omitted.

A remote controller 622 includes a button F/B (front/back) in addition to the button R/L, the button O, the button S, and the button C. The button F/B selects the curtain rail 264 or the curtain rail 261. When the user presses any of these buttons, the remote controller 612 transmits a wireless signal indicating that the button is pressed to the antenna 601.

In response to the signal received by the antenna 601, the control unit 610 controls electricity supplied to the power supply pattern 231 and the power supply pattern 236 of the curtain rail 261, and electricity supplied to the power supply pattern 231 and the power supply pattern 236 of the curtain rail 264 to move the four movable bodies 100.

In each of the above-mentioned embodiments, the power supply pattern 211 and the power supply pattern 212, the power supply pattern 231 and the power supply pattern 236, and the power supply pattern 241 and the power supply pattern 246 extend along the left inner side face and the right inner side face of the curtain rail 200 and the like, respectively, and, however, each of the power supply patterns may extend along the inner side of the upper face of the curtain rail. Each of the power supply patterns may extend overlapping the wheel travelling portion 221 and the wheel travelling portion 222, and the whole or a part of the wheel 121, the wheel 122, the wheel 123, and the wheel 124 may be used as the electrode.

Although the movable body 100 and the movable body 150 have the wheel 121, the wheel 122, the wheel 123, and the wheel 124 in each of the above-mentioned embodiments, the number of wheels may be two or six, and the movable body 100 and the movable body 150 may have any number of wheels.

In the first embodiment, second embodiment, and third embodiment, the movable body 150 may be used in place of the movable body 100. A movable body provided with three or more electrodes on each of the right side face and the left side face may be adopted.

Although the movable body 100 or the movable body 150 has been referred to in connection with the fourth embodiment, a movable body provided with three or more electrodes on each of the right side face and the left side face may be used instead. However, in this case, a distance between the electrodes at both ends of the right side face needs to exceed the longitudinal width Y of the first insulating portion 233, and a distance between the electrodes at both ends of the left side face needs to exceed the longitudinal width Y' of the second insulating portion 238.

Although the electric curtain opening and closing device 5 in the modification example of the above-described fourth embodiment is for the one-way draw curtain, the curtain rail 262 and the two movable bodies 100 in FIG. 11 and FIG. 12 may be used to constitute an electric curtain opening and closing device for the two-way draw curtain.

In the above-described third embodiment, the control unit 300 can individually move the left movable body 100 and the right movable body 100 and, however, the control unit 300 may simultaneously move the left movable body 100 and the right movable body 100 in cooperation.

However, in this case, when detecting that the left movable body 100 contacts the detector 251 in the vicinity of the left end or the detector 252 located a little to the left with respect to the center, even when the right movable body 100 is moving, the control unit 300 turns off the power source 501 to stop the left movable body 100. Similarly, when detecting that the detector 253 located a little to the left with respect to the center or the detector 250 in the vicinity of the right end, even when the left movable body 100 is moving, the control unit 300 turns off the power source 502 to stop the right movable body 100.

Although the above-described fifth embodiment describes the electric curtain opening and closing device 6 for the two-way draw curtain, the curtain rail 263 may be used to constitute an electric curtain opening and closing device for the one-way draw curtain.

Similarly, although the above-described sixth embodiment describes the electric curtain opening and closing device 7 for the two-way draw curtain, the curtain rail 261 and the curtain rail 264 may be used to constitute an electric curtain opening and closing device for double and one-way draw curtains.

In each of the above-mentioned embodiments, the detector 251, the detector 252, the detector 253, and the detector 254 each are a contact switch and, however, these detectors may be any device such as an infrared sensor as long as they can detect the location of the movable body 100 and the movable body 150.

In each of the above-mentioned embodiments, although the electric motor 102 is, for example, the DC motor, the electric motor 102 may be any motor as long as it can switch between the positive rotation and negative rotation, and control the rotating speed.

As has been described, according to the present invention, it is possible to provide the light-weight and low-cost electric curtain opening and closing device that does not cause the breakage and the electric leakage of the electric cord. Although the embodiments of the present invention have been described, various modifications and combinations that are required for design and other factors fall within the scope of the invention, which corresponds to the invention recited in Claims and the specific examples described in the embodiments of the invention.

The invention claimed is:

1. An electric curtain opening and closing device comprising:

a curtain rail which has a hollow portion that is hollow extending in a longitudinal direction, one face constituting the hollow portion including an opening opened in the longitudinal direction, and in which a power supply pattern for supplying electricity is arranged on an inner side of any face constituting said hollow portion in the longitudinal direction; and a movable body which has an electrode in contact with said power supply pattern, an electric motor receiving electricity through the electrode to positively or negatively rotate, and a hanging portion for hanging a curtain, and which moves by being driven by said electric motor, wherein said power supply pattern includes:

a first power supply pattern extending in the longitudinal direction, and having a first conducting portion and a second conducting portion each including a conductor that conducts electricity, and a first insulating portion sandwiched between the first conducting portion and the second conducting portion so that the first conducting portion and the second conducting portion are connected with each other in series via the first insulating portion, the first insulating portion including an electrical insulator so as not to conduct current from either one of the first conducting portion and second conducting portion to another of said first conducting portion and second conducting portion; and a second power supply pattern extending in the longitudinal direction, and having a third conducting portion and a fourth conducting portion each including a conductor that conducts electricity, and a second insulating portion sandwiched between the third conducting portion and the fourth conducting portion so that the third conducting portion and the fourth conducting portion are connected with each other in series via the second insulating portion, the second insulating portion including an electrical insulator so as not to conduct current from either one of the third conducting portion and fourth conducting portion to another of said third conducting portion and the fourth conducting portion; and wherein when said movable body is arranged in the hollow portion of said curtain rail, said hanging portion protrudes from said opening.

2. The electric curtain opening and closing device according to claim 1, wherein the device is a curtain opening and closing device for a two-way draw curtain, wherein the device includes:

a first power source applying a first voltage between the first conducting portion of said first power supply pattern and the third conducting portion of said second power supply pattern; and a second power source applying a second voltage between the second conducting portion of said first power supply pattern and the fourth conducting portion of said second power supply pattern, and wherein said movable body comprises a first moveable body that moves by electricity supplied from said first power source, and a second movable body that moves by electricity supplied from said second power source.

3. The electric curtain opening and closing device according to claim 1, further comprising:

a wireless signal transmission device that transmits a wireless signal for controlling movement of said movable body;

a wireless signal reception circuit that receives the wireless signal transmitted from said wireless signal transmission device;

a power source that supplies electricity to said power supply pattern; and a control unit that controls electricity supplied to said power supply pattern from said power source in response to the wireless signal received by said wireless signal reception circuit to control speed of said movable body in a housing of said curtain rail.

4. The electric curtain opening and closing device according to claim 2, further comprising:

a wireless signal transmission device that transmits a wireless signal for controlling movement of said movable body;

a wireless signal reception circuit that receives the wireless signal transmitted from said wireless signal transmission device;

a power source that supplies electricity to said power supply pattern; and a control unit that controls electricity supplied to said power supply pattern from said power source in response to the wireless signal received by said wireless signal reception circuit to control speed of said movable body in a housing of said curtain rail.

5. An electric curtain opening and closing device comprising:

a curtain rail which has a hollow portion that is hollow extending in a longitudinal direction, one face constituting the hollow portion including an opening opened in the longitudinal direction, and in which a power supply pattern for supplying electricity is arranged on an inner side of any face constituting said hollow portion in the longitudinal direction; and a movable body which has an electrode in contact with said power supply pattern, an electric motor receiving electricity through the electrode to positively or negatively rotate, and a hanging portion for hanging a curtain, and which moves by being driven by said electric motor;

wherein said power supply pattern includes:

a first power supply pattern extending in the longitudinal direction, and having a first conducting portion and a second conducting portion each including a conductor that conducts electricity and a first insulating portion sandwiched between the first conducting portion and the second conducting portion and including an insulator that does not conduct electricity from either one of the first conducting portion and second conducting portion to another of said first conducting portion and second conducting portion; and a second power supply pattern extending in the longitudinal direction, and having a third conducting portion and a fourth conducting portion each including a conductor that conducts electricity and a second insulating portion sandwiched between the third conducting portion and the fourth conducting portion and including an insulator that does not conduct electricity from either one of the third conducting portion and fourth conducting portion to another of said third conducting portion and fourth conducting portion; and wherein said electric curtain opening and closing device further comprises:

a wireless signal transmission device that transmits a wireless signal for controlling movement of said movable body;

a wireless signal reception circuit that receives the wireless signal transmitted from said wireless signal transmission device;

a power source that supplies electricity to said power supply pattern; and a control unit that controls electricity supplied to said power supply pattern from said power source in response to the wireless signal received by said wireless signal reception circuit to control movement of said movable body in a housing of said curtain rail; and wherein when said movable body is arranged in the hollow portion of said curtain rail, and said hanging portion protrudes from said opening.

6. An electric curtain opening and closing device, comprising:

a curtain rail extending in a longitudinal direction and having a length along which the curtain rail is hollow while having an opening into the hollow, the curtain rail having a first face and, an opposing, second face extending in said longitudinal direction within the hollow;

a first power supply pattern comprising a first conducting portion extending in said longitudinal direction along said first face and spanning a first length portion of the curtain rail and a second conducting portion extending in said longitudinal direction along said second face and spanning said first length portion of the curtain rail;

a second power supply pattern comprising a third conducting portion extending in said longitudinal direction along said first face and spanning a second length portion of the curtain rail and a fourth conducting portion extending in said longitudinal direction along said second face and spanning said second length portion of the curtain rail;

a first insulating portion extending in said longitudinal direction along said first face;

a second insulating portion extending in said longitudinal direction along said second face;

wherein said first length portion and said second length portion do not overlap along said first face, are not co-extensive along said first face, and are separated in said longitudinal direction along said first face by said first insulating portion;

wherein said first length portion and said second length portion do not overlap along said second face, are not co-extensive along said second face, and are separated in said longitudinal direction along said second face by said second insulating portion;

a first movable body movable within the hollow of the curtain rod, and comprising a first electric motor, a first electrode and a second electrode, the first electrode being in contact with said first conducting portion of said first power supply pattern and the second electrode being in contact with said second conducting portion of said first power supply pattern;

a second movable body movable within the hollow of the curtain rod, and comprising a second electric motor, a third electrode and a fourth electrode, the third electrode being in contact with said third conducting portion of said second power supply pattern and the fourth electrode being in contact with said fourth conducting portion of said second power supply pattern;

a first fitting coupled to the first electric motor, protruding through said opening in said curtain rod, and adapted to be coupled to a first portion of said electric curtain, the first fitting being moved by said first electric motor relative to said curtain rail in either one of a first direction or an opposite, second direction; and a second fitting coupled to the second electric motor, protruding through said opening in said curtain rod, and adapted to be coupled to a second portion of said electric curtain, the second fitting being moved by said second electric motor relative to said curtain rail in either one of said first direction or said second direction.

7. The electric curtain opening and closing device of claim 6, further comprising:

a wireless signal transmission device that transmits a wireless signal for controlling movement of said first movable body;

a wireless signal reception circuit that receives the wireless signal transmitted from said wireless signal transmission device;

a power source that supplies electricity to said first power supply pattern; and a control unit that controls electricity supplied to said first power supply pattern from said power source in response to the wireless signal received by said wireless signal reception circuit to control speed of said first movable along said curtain rail.

8. The electric curtain opening and closing device of claim 6, further comprising:

a wireless signal transmission device that transmits a first wireless signal for controlling movement of said first movable body and a second wireless signal for controlling movement of said second movable body;

a first wireless signal reception circuit that receives the first wireless signal transmitted from said wireless signal transmission device;

a second wireless signal reception circuit that receives the second wireless signal transmitted from said wireless signal transmission device;

a power source that supplies electricity to said first power supply pattern and said second power supply pattern; and a control unit that controls electricity supplied to said first power supply pattern from said power source in response to the first wireless signal received by said first wireless signal reception circuit to control speed of said first movable body along said curtain rail, and that controls electricity supplied to said second power supply pattern from said power source in response to the second wireless signal received by said second wireless signal reception circuit to control speed of said second movable body along said curtain rail.

* * * * *